United States Patent [19]

Harada

[11] Patent Number: 4,522,045

[45] Date of Patent: Jun. 11, 1985

[54] PORTABLE SMALL-SIZED WASHING MACHINE

[76] Inventor: Michiko Harada, 1-62, 3-chome, Suimeidai, Kawanishi-shi, Hyogo, Japan

[21] Appl. No.: 528,124

[22] Filed: Aug. 31, 1983

[30] Foreign Application Priority Data

Sep. 20, 1982 [JP] Japan ..... 57-143842[U]

[51] Int. Cl.[3] ..... D06F 7/02

[52] U.S. Cl. ..... 68/22 A; 68/131; 68/208

[58] Field of Search ..... 68/3 R, 22 A, 53, 131, 68/132, 133, 181 R, 181 D, 208, 213, 214, 232, 235 D

[56] References Cited

U.S. PATENT DOCUMENTS

| | | | |
|---|---|---|---|
| 1,664,792 | 4/1928 | Ruffner | 68/53 |
| 2,729,087 | 1/1956 | Harrell | 68/131 |
| 2,785,558 | 3/1957 | Broderick | 68/22 A |
| 3,206,952 | 9/1965 | McCarthy | 68/181 R X |

FOREIGN PATENT DOCUMENTS

| | | | |
|---|---|---|---|
| 55145 | 8/1938 | Denmark | 68/133 |
| 497066 | 8/1954 | Italy | 68/22 A |

*Primary Examiner*—Philip R. Coe

*Attorney, Agent, or Firm*—Wenderoth, Lind & Ponack

[57] ABSTRACT

A portable small-sized washing machine is proposed. The washing tub of this machine has a capacity of washing about ten dishcloths at the most, each of these dishcloths being about 30 cm square.

2 Claims, 2 Drawing Figures

PORTABLE SMALL-SIZED WASHING MACHINE

BACKGROUND OF THE INVENTION

1. Field of the Invention

The present invention relates to a portable small-sized washing machine adapted to wash small articles such as dishcloths.

2. Description of the Prior Art

For cleaning the dishcloths, it has been a common practice to wash them by hand with a detergent and a sterilizer. It has also been a common practice to wear rubber gloves so as to prevent the hands from being chapped by the detergent and the sterilizer. However, the rubber gloves render it difficult for the dishcloths to be sufficiently cleaned. Moreover, there is the possibility that the dishcloths may be smudged stains with which the rubber gloves may have covered.

On the other hand, it is not economical to wash the dishcloths in a washing machine allotted for washing very soiled clothes.

SUMMARY OF THE INVENTION

It is an object of the present invention to provide a portable small-sized washing machine handy to carry and adapted to wash a small quantity of articles such as dishcloths.

The washing machine in accordance with the present invention is provided with a washing tub which has a capacity of washing about ten dishcloths at the most, each of these dishcloths being about 30 cm square. It is small-sized and handy to carry so as to be usable even in a kitchen. The washing tub is made of a transparent or semitransparent material so that one can tell how dirty the washing water contained therein has become. Thus the washing machine in accordance with the present invention is adapted for the substantially exclusive use of washing dishcloths, to which cleanliness is essential in view of their use as cloths for drying dishes.

With the above-described object in view and as will become apparent from the following detailed description, the present invention will be more clearly understood in connection with the accompanying drawings.

DETAILED DESCRIPTION OF THE PREFERRED EMBODIMENT

Figure 1:
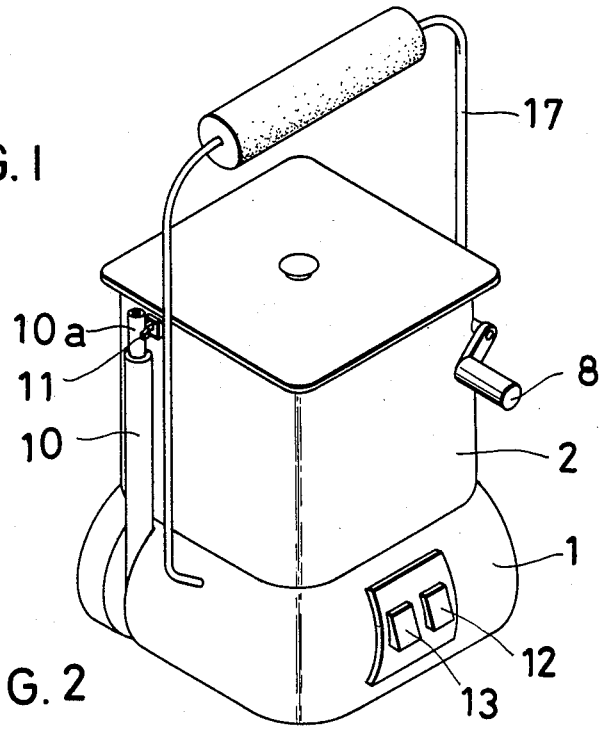
FIG. 1 is a perspective view of an embodiment of the present invention.
Figure 2:
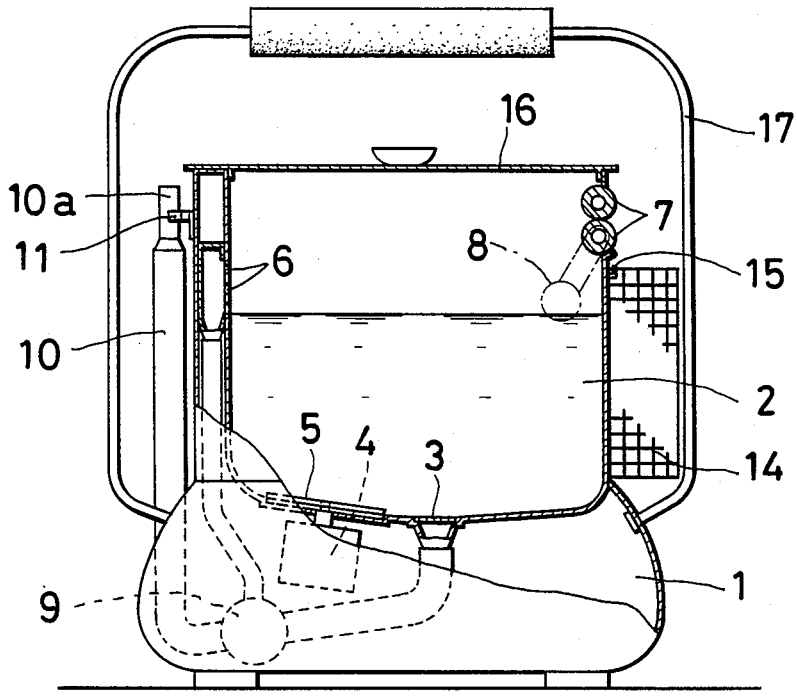
FIG. 2 is a vertical sectional view thereof.

Referring now to the drawings, a washing machine in accordance with the present invention includes a main body 1 and a transparent or semitransparent washing tub 2 mounted on the main body 1. A drainage opening 3 and a pulsator 5 are provided in and near the center of the bottom of the washing tub 2, respectively. The pulsator 5 is adapted to be driven by a motor 4 which is secured to the main body 1. An overflow opening 6 is provided in the upper part of a side wall of the washing tube 2. A wringer 7 is provided in the opposite side wall and at a higher position than the lower edge of the overflow opening 6. Two rollers 7 constituting the wringer can be revolved on their axes by manipulating a handle 8 connected to one of the two rollers. Preferably, the washing tub 2 has a capacity of washing ten dishcloths at the most, each of these dishcloths being about 30 cm square. As the case may be, however, it is enough for the washing tub 2 to have a capacity of washing five or six dishcloths.

The drainage opening 3 and the overflow opening 6 communicate with a drain hose 10 through a valve 9. The end portion 10*a* of the drain hose 10 is detachably supported by a hose clip 11 which is provided on the external surface of the washing tub 2. The overflow opening 6 is always in communication with the drain hose 10, while the communication between the drainage opening 3 and the drain hose 10 can be controlled by the valve 9 which is actuated by a drainage blocking switch 12. The switch 12 is provided adjacently to a motor switch 13 on the main body 1. When the switch 12 is pushed on, the communication between the drainage opening 3 and the drain hose 10 is intercepted by the valve 9 so as to prevent the water from draining out of the washing tub 2 through the drainage opening 3. When the switch 12 is turned off, the drainage opening 3 and the drain hose 10 are allowed to communicate with each other by the valve 9 so as to allow the water to drain out of the washing tub 2 through the drainage opening 3. The motor 4 is switched on and off by the motor switch 13.

The rollers 7 remove excess moisture from the wash by wringing it therebetween and deliver the wash into a basket 14 which is detachably supported on a hook 15. The hook 15 is provided under the rollers 7 on the external surface of the washing tub 2. The washing tub 2 is covered with a detachable lid 16. A handle 17 is hingedly attached to the main body 1.

The handle 17 may be of a fixed type. The washing tub 2 may be covered with a casing made of a transparent or semitransparent material and extending upwardly from the main body 1. It is preferable to provide a timer for automatically stopping the machine at a given time, e.g. 10 minutes after starting the motor 4 by the switch 13, so that one may not be endangered by a failure to switch off the motor 4 at a proper time. Another timer for setting the operating interval may also be provided in the main body 1.

Preferably, the embodiment shown in the drawings, exclusive of the handle 17, is about 30 cm in height and about 30 cm in maximum breadth. These dimensions are enough for allowing the machine to wash a small quantity of articles such as dishcloths.

What I claim is:

1. A portable washing machine comprising:

a main body, a washing tub mounted on said main body and provided with a bottom and a plurality of side walls, a drainage opening and a pulsator provided at the bottom of the washing tub, a wringer provided on one side wall of the washing tub, an overflow opening provided on another side wall of the washing tub, a motor means, secured to said main body, for driving said pulsator, and a handle means, attached to the main body, for carrying the washing machine.

2. The portable washing machine, according to claim 1, wherein:

said side walls of the washing tube are transparent.

* * * * *